US009845575B2

(12) United States Patent
Westland et al.

(10) Patent No.: US 9,845,575 B2
(45) Date of Patent: Dec. 19, 2017

(54) FIBRILLATED BLEND OF LYOCELL LOW DP PULP

(75) Inventors: John A. Westland, Auburn, WA (US); Andrew J Dodd, Seattle, WA (US); Mengkui Luo, Auburn, WA (US); Noriko Suzuki, Seattle, WA (US); S. Ananda Weerawarna, Seattle, WA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 740 days.

(21) Appl. No.: 12/466,227

(22) Filed: May 14, 2009

(65) Prior Publication Data

US 2010/0288456 A1 Nov. 18, 2010

(51) Int. Cl.

| | |
|---|---|
| ***D21H 17/33*** | (2006.01) |
| ***D21H 17/25*** | (2006.01) |
| ***D21H 17/35*** | (2006.01) |
| *D21H 11/18* | (2006.01) |
| *D21H 13/02* | (2006.01) |
| *D21H 13/08* | (2006.01) |

(52) U.S. Cl.

CPC ..... *D21H 17/33* (2013.01); *D21H 17/25* (2013.01); *D21H 17/35* (2013.01); *D21H 11/18* (2013.01); *D21H 13/02* (2013.01); *D21H 13/08* (2013.01)

(58) Field of Classification Search

USPC ..... 162/157.7

See application file for complete search history.

(56) References Cited

U.S. PATENT DOCUMENTS

| | | | | |
|---|---|---|---|---|
| 6,465,379 | B1 | 10/2002 | Cook et al. | |
| 6,524,348 | B1 * | 2/2003 | Jewell et al. | 8/116.1 |
| 7,566,014 | B2 | 7/2009 | Koslow et al. | |
| 2002/0000683 | A1 | 1/2002 | Sears et al. | |
| 2002/0036070 | A1 | 3/2002 | Luo et al. | |
| 2004/0206463 | A1 * | 10/2004 | Luo et al. | 162/21 |
| 2005/0019564 | A1 | 1/2005 | Kwon et al. | |
| 2005/0142973 | A1 | 6/2005 | Bletsos et al. | |
| 2005/0284595 | A1 | 12/2005 | Conley | |
| 2007/0224419 | A1 | 9/2007 | Sumnicht | |
| 2008/0054107 | A1 | 3/2008 | Koslow et al. | |
| 2009/0020139 | A1 | 1/2009 | Sumnicht | |

FOREIGN PATENT DOCUMENTS

| | | |
|---|---|---|
| EP | 0635275 A1 | 1/2002 |
| WO | 2005040495 A1 | 5/2005 |

OTHER PUBLICATIONS

Smook, Handbook for Pulp and Paper Technologists, 1992, Angus Wilde Publications, 2nd edition, chapters 1 and 13.*

ASTM International, D 1795-96 (reapproved 2007), 2007.*

Chirat et al., Use of Ozone in a Last Bleaching Stage, 1996, 1996 TAPPI Pulping Conference p. 99-102.*

Knudson, Harold, Filter Paper Studies I: Effect of replacing Esparato with Yucca Fibers, 1948, Naval Research Laboratory, p. 2.*

SBHK, downloaded from web.archive.org/20090503062310/http://www.internationalpaper.com/Paper/Paper%29Products/Pulp/Southern_Bleached_Ha.html [downloaded online Sep. 26, 2013], May 3, 2009, International Paper Company.*

Paper and Tissue Pulp, downloaded from www.internationalpaper.com/US/EN/Products/Pulp/PaperTissue.html [downloaded online Sep. 26, 2013], International Paper Company.*

Forstall, Fred, Wood Pulp and Waste Paper, Feb. 2002, US International Trade Commission.*

Johnson, Pam, "Courtaulds Lyocell—a Cellulosic Fibre for Special Papers and Nonwovens", TAPPI Proceedings, 1996 Nonwovens Conference.

Luo, Mengkui, et al, "High Yield Lyocell Pulp from the Kraft Process, 4th International Symposium/Alternative Cellulose-Manufacturing, Forming, Properties" Sep. 2007, Rudolstadt, Germany.

Engineered Fibers Technology Manufacturing Services, http://www.eftfibers.com/manufacturing.htm, Nov. 2008.

Luo, Mengkui, "Kraft Lyocell Pulp and the Lyocell Fiber Produced from the Pulp", Proceedings of The Textile Institute 83rd World Conference, May 2004, Shanghai, China.

Homonoff, E.C. et al., Nanofibrillated Cellulose Fibers: Where Size Matters in Opening New Markets to Nanofiber Usage, Presentation to 2008 TAPPI Nanotechnology Conference, Jun. 25-27, 2008, St. Louis, MO, US.

Johnson, et al., Mycelia Paper: A potential Resource Recovery Process?, 1977, IPC Technical Paper Series.

Engineered Fibers Technology, LLC, "EFTec Nanofibrillated Fibers," <https://www.eftec.com> [retrievable at https://webarchive.org/web/20080328063420/http://eftfibers.com:80/p4.btm>], available as early as Mar. 28, 2008, 3 pages.

* cited by examiner

*Primary Examiner* — Anthony Calandra

(74) *Attorney, Agent, or Firm* — Christensen O'Connor Johnson Kindness PLLC

(57) ABSTRACT

A fibrillated blend of lyocell and cellulosic pulp having a degree of polymerization of 200 to 1000 as measured by ASTM Test 1795-96, a method of making the blend and materials which incorporate the blend.

15 Claims, No Drawings

FIBRILLATED BLEND OF LYOCELL LOW DP PULP

The field of this invention is a dispersible fibrillated blend of lyocell and low DP cellulosic pulp, the method of making the blend and uses of the blend.

It has been proposed to use fibrillated lyocell as a reinforcing agent for various materials. Applicants have found, however, that fibrillated lyocell by itself does not perform well as a reinforcing agent. It does not disperse well and, therefore, does not provide the required physical attributes such as toughness. Fibrillated lyocell tends to agglomerate or bundle. This makes it difficult to use as a reinforcement or as a filter medium because it bundles together and does not disperse throughout the material.

Applicants have found that a fibrillated blend of lyocell and a cellulosic pulp having a low degree of polymerization (DP) provides a material that does disperse, does filter well, and does provide better modulus of elasticity and strength while maintaining toughness. What physical attributes are provided and how much is provided will depend on the material with which the fibrillated blend of lyocell and low DP cellulosic pulp is combined.

In one embodiment the DP of the low DP pulp can be from 200 to 1000 as measured by ASTM Test 1795-96 which uses a Cuene (cupriethylenediamine) solvent. In another embodiment the DP of the low DP pulp can be from 300 to 850 as measured by ASTM Test 1795-96. In another embodiment the DP of the low DP pulp can be from 400 to 750 as measured by ASTM Test 1795-96. Low DP pulp includes pulp fines.

In one embodiment the blend can be from 25 to 75 percent by weight lyocell with the remainder low DP pulp. In one embodiment the lyocell can be 40 to 60 percent by weight lyocell with the remainder low DP pulp. In one embodiment the lyocell can be 50 percent by weight with the remainder low DP pulp.

In one embodiment the lyocell has a length of 3 to 12 mm. In one embodiment the lyocell has a length of 3 to 10 mm. In one embodiment the lyocell has a length of 4 to 8 mm. In each of these embodiments fibril of the fibrillated lyocell usually has a diameter or width in the range of 30 to 800 nanometers to provide an aspect ratio of greater than 100 to one million or more.

The low DP material breaks into fibrils, particles and fines which are useful in dispersing the lyocell material.

The blend could be incorporated into various materials such as rubber, polyvinyl alcohol, other elastomeric materials, cellulose ethers, polyurethane, polylactic acid and latexes such as polystyrene-co-butyl acrylate and in water soluble polymers. It could be incorporated into materials in which biodegradability as well as high maximum strength, modulus of elasticity and strength to rupture are required. The blend could be incorporated into adhesives to provide thermal creep. The blend could be used as a rheological modifier in water borne coatings. The blend could also be used in starch based materials.

The fact that this blend disperses is surprising because applicants have found that a fibrillated blend of lyocell and a pulp having a DP of 1100 or more as measured by ASTM Test 1795-96 does not perform well. It does not disperse well and does not filter well. Applicants have also found that a low DP pulp, either non-fibrillated or fibrillated, does not perform well. It does not disperse well, does not filter well and does not provide the required physical attributes.

Cellulose is normally fibrillated at high energy, increasing the cost of production. It has been thought that high energy is required for its production.

Applicants have found that in one embodiment the blend of lyocell and low DP pulp can be fibrillated at an energy of less than 500 kwh per ton of blend and perform well. Applicants have found that in one embodiment the blend of lyocell and low DP pulp can be fibrillated at an energy of less than 100 kwh per ton of blend and perform well. Applicants have found that in one embodiment the blend of lyocell and low DP pulp can be fibrillated at an energy of less than 10 kwh per ton of blend and perform well.

Starting Materials

Lyocell and low DP pulp have cellulose, and in some instances hemicellulose and lignin as main constituents. The usual starting materials for both lyocell and the low DP pulp include, but are not limited to, trees, grass and recycled paper. The starting materials, from whatever source, are initially converted to a pulp. The pulp is a chemical wood pulp such as a kraft wood pulp, which can be bleached, lightly bleached or unbleached. The lightly bleached and unbleached pulp will contain lignin. The pulping raw materials are sources of cellulose, hemicellulose and lignin and the terms "wood" or "tree" will be used to generically describe any source of cellulose, hemicellulose and lignin. In the wood pulping industry, trees are conventionally classified as either hardwood or softwood. Examples of softwood species from which pulp useful as a starting material for both lyocell and low DP pulp include, but are not limited to: fir such as Douglas fir and Balsam fir, pine such as Eastern white pine and Loblolly pine, spruce such as White spruce, larch such as Eastern larch, cedar, and hemlock such as Eastern and Western hemlock. Examples of hardwood species from which pulp useful as a starting material for both lyocell and low DP pulp include, but are not limited to: acacia, alder such as Red alder and European black alder, aspen such as Quaking aspen, beech, birch, oak such as White oak, gum trees such as eucalyptus and Sweetgum, poplar such as Balsam poplar, Eastern cottonwood, Black cottonwood and Yellow poplar, gmelina and maple such as Sugar maple, Red maple, Silver maple and Bigleaf maple.

Wood from softwood or hardwood species generally includes three major components: cellulose, hemicellulose and lignin. Cellulose makes up about 50% of the woody structure of plants and is an unbranched polymer of D-glucose monomers. Individual cellulose polymer chains associate to form thicker microfibrils which, in turn, associate to form fibrils which are arranged into bundles. The bundles form fibers which are visible as components of the plant cell wall when viewed at high magnification under a light microscope or scanning electron microscope. Cellulose is highly crystalline as a result of extensive intramolecular and intermolecular hydrogen bonding.

The term hemicellulose refers to a heterogeneous group of low molecular weight carbohydrate polymers that are associated with cellulose in wood. Hemicelluloses are amorphous, branched polymers, in contrast to cellulose which is a linear polymer. The principal, simple sugars that combine to form hemicelluloses are: D-glucose, D-xylose, D-mannose, L-arabinose, D-galactose, D-glucuronic acid and D-galacturonic acid.

Lignin is a complex aromatic polymer and comprises about 20% to 40% of wood where it occurs as an amorphous polymer. Lignins can be grouped into three broad classes, including softwood or coniferous (gymnosperm), hardwood (dicotyledonous angiosperm), and grass or annual plant (monocotyledonous angiosperm) lignins. Softwood lignins are often characterized as being derived from coniferyl alcohol or guaiacylpropane (4-hydroxy-3-methoxyphenylpropane) monomer. Hardwood lignins contain polymers of 3,5-dimethoxy-4-hydroxyphenylpropane monomers in addition to the guaiacylpropane monomers. The grass lignins contain polymers of both of these monomers, plus 4-hydroxyphenylpropane monomers. Hardwood lignins are much more heterogeneous in structure from species to species than the softwood lignins when isolated by similar procedures.

Pulping Procedure

In the pulping industry, differences in the chemistry of the principal components of wood are exploited in order to purify cellulose. For example, heated water in the form of steam causes the removal of acetyl groups from hemicellulose with a corresponding decrease in pH due to the formation of acetic acid. Acid hydrolysis of the carbohydrate components of wood then ensues, with a lesser hydrolysis of lignin. Hemicelluloses are especially susceptible to acid hydrolysis, and most can be degraded by an initial steam, prehydrolysis step if one is used in the Kraft pulping process, as will be described in the dissolving pulp section, or in an acidic sulfite cooking process.

With respect to the reaction of wood with alkali solutions, all components of wood are susceptible to degradation by strong alkaline conditions. At the elevated temperature of 140° C. or greater that is typically utilized during Kraft wood pulping, the hemicelluloses and lignin are preferentially degraded by dilute alkaline solutions. Additionally, all components of wood can be oxidized by bleaching agents such as chlorine, oxygen, ozone, sodium hypochlorite and hydrogen peroxide.

Conventional pulping procedures, such as sulfite pulping or alkaline pulping, can be used to provide a wood pulp useful both for making lyocell fibers and for making a low DP pulp. An example of a suitable alkaline pulping process is the kraft process, without an acid prehydrolysis step. Normal kraft pulps are not subject to acid prehydrolysis. By avoiding the acid pretreatment step prior to alkaline pulping, the overall cost of producing the pulped wood is reduced. A kraft pulping process with a prehydrolysis step will be discussed under dissolving pulp.

A normal kraft wood pulp would have a hemicellulose content of from 7% to about 30% by weight; and a lignin content of from 0% to about 20% by weight. The lignin content will depend upon the amount of bleaching. Percent by weight when applied to the cellulose or hemicellulose or lignin content of pulp means weight percentage relative to the dry weight of the pulp.

The pulp may be subjected to bleaching by any conventional bleaching process utilizing bleaching agents including, but not limited to, chlorine, chlorine dioxide, oxygen, ozone, sodium hypochlorite, peracids and hydrogen peroxide.

Lyocell

Regenerated cellulose fibers may be prepared using various amine oxides or ionic liquids as solvents. In particular, N-methylmorpholine-N-oxide (NMMO) with about 12% water present proved to be a particularly useful solvent. The cellulose is dissolved in the solvent under heated conditions, usually in the range of 90° C. to 130° C., and extruded from a multiplicity of fine apertured spinnerets into air. The filaments of cellulose dope are continuously mechanically drawn in air by a factor in the range of about three to ten times to cause molecular orientation. They are then led into a nonsolvent, usually water, or water/NMMO mixture to regenerate the cellulose. Other regeneration solvents, such as lower aliphatic alcohols, have also been suggested.

Other solvents that can be mixed with NMMO, or another tertiary amine solvent, include dimethylsulfoxide (DMSO), dimethylacetamide (DMAC), dimethylformamide (DMF) and caprolactan derivatives. Ionic liquids or mixtures of ionic liquids and aprotic or protic liquids are also suitable. Examples of the cation moiety of ionic liquids are cations from the group consisting of cyclic and acyclic cations. Cyclic cations include pyridinium, imidazolium, and imidazole and acyclic cations include alkyl quaternary ammonium and alkyl quaternary phosphorous cations. Counter anions of the cation moiety are selected from the group consisting of halogen, pseudohalogen and carboxylate. Carboxylates include acetate, citrate, malate, maleate, formate, and oxylate and halogens include chloride, bromide, zinc chloride/choline chloride, 3-methyl-N-butyl-pyridinium chloride and benzyldimethyl (tetradecyl) ammonium chloride. Substituent groups, (i.e. R groups), on the cations can be $C_1$, $C_2$, $C_3$, and $C_4$; these can be saturated or unsaturated. Examples of compounds which are ionic liquids include, but are not limited to, 1-ethyl-3-methyl imidazolium chloride, 1-ethyl-3-methyl imidazolium acetate, 1-butyl-3-methyl imidazolium chloride, 1-allyl-3-methyl imidazolium chloride. Pulps used for lyocell will usually fully dissolve in NMMO or ionic liquid in 10 to 90 minutes. Shorter times are preferred. The term "fully dissolve", when used in this context, means that substantially no undissolved particles are seen when a dope, formed by dissolving compositions of the present invention in NMMO or ionic liquids, is viewed under a light microscope at a magnification of 40× to 70×.

Cellulose textile fibers spun from NMMO or ionic liquid solution are referred to as lyocell fibers. Lyocell is an accepted generic term for a fiber composed of cellulose precipitated from an organic solution in which no substitution of hydroxyl groups takes place and no chemical intermediates are formed. One lyocell product produced by Lenzing AG is presently commercially available as Tencel® fiber. These fibers are available in 0.9-5.7 denier weights and heavier. Denier is the weight in grams of 9000 meters of a fiber. Because of their fineness, yarns made from them produce fabrics having extremely pleasing hands. The term "lyocell" in this applicaton includes polynosic fiber.

Two widely recognized problems of lyocell fabrics are caused by fibrillation of the fibers under conditions of wet abrasion, such as might result during laundering. Fibrillation tends to cause "pilling"; i.e., entanglement of fibrils into small relatively dense balls. It is also responsible for a "frosted" appearance in dyed fabrics. Fibrillation is believed to be caused by the high orientation and apparent poor lateral cohesion within the fibers. There is an extensive technical and patent literature discussing the problem and proposed solutions.

The lyocell can be made from a bleached or unbleached pulp or a mixture of pulp and lignin. The pulp may be a traditional dissolving pulp or a kraft pulp containing hemicellulose and having a DP of 200 to 1100, and a hemicellulose content of 3 to 20% and has been specially treated to be compatible with lyocell solvents such as the amine oxides and ionic liquid and other solvents noted above.

Pulps used for lyocell, including the specially treated kraft pulp, have a number of attributes that allow then to be compatible with the lyocell solvents, such as amine oxide and ionic liquid and other solvents noted above. The lyocell pulps have a copper number of less than about 2.0, and can have a copper number less than about 0.7, as measured by Tappi T430 cm-99. The lyocell pulps have a carbonyl content of less than about 120 μmol/g and a carboxyl content of less than about 120 μmol/g. The carboxyl and carbonyl group content are measured by TAPPI TM 237 or by means of proprietary assays performed by Thuringisches Institut fur Textil-und Kunstoff Forschunge. V., Breitscheidstr. 97, D-07407 Rudolstadt, Germany.

The lyocell pulps possess a low transition metal content. Preferably, the total transition metal content is less than 20 ppm, more preferably less than 5 ppm, as measured by Tappi 266 om-94. The term "total transition metal content" refers to the combined amounts, measured in units of parts per million (ppm), of nickel, chromium, manganese, iron and copper. The lyocell pulps have an iron content that is less than 4 ppm, more preferably less than 2 ppm, as measured by Tappi 266 om-94, and the copper content of pulp used for lyocell is preferably less than 1.0 ppm, more preferably less than 0.5 ppm, as measured by Tappi 266 om-94.

Additionally, lyocell fibers may have a natural crimp of irregular amplitude and period that confers a natural appearance on the fibers. The crimp amplitude may be greater than about one fiber diameter and the crimp period is greater than about five fiber diameters.

Processes for Forming Fibers

As described above, one process for forming lyocell fibers is the dry jet/wet process. In this process the filaments exiting the spinneret orifices are mechanically drawn through an air gap and then submerged and coagulated and stretched mechanically in a liquid bath before drying. Dried lyocell fiber can be cut to different length from 2 to 12 mm. Never dried lyocell can be cut to 2 to 12 mm too and used directly for fibrillation.

Another process is generally termed "melt blowing". The fibers are extruded through a series of small diameter orifices into an air stream flowing generally parallel to the extruded fibers. This draws or stretches the fibers. The stretching serves two purposes. It causes some degree of longitudinal molecular orientation and reduces the ultimate fiber diameter. Melt-blowing typically produces fibers having a small diameter (most usually less than 10 μm) which are useful for producing non-woven materials.

In one embodiment of the melt-blowing method, the dope is transferred at somewhat elevated temperature to the spinning apparatus by a pump or extruder at temperatures from 70° C. to 140° C. Ultimately the dope is directed to an extrusion head having a multiplicity of spinning orifices. The dope filaments emerge into a relatively high velocity turbulent gas stream flowing in a generally parallel direction to the path of the latent fibers. As the dope is extruded through the orifices the liquid strands or latent filaments are drawn (or significantly decreased in diameter and increased in length) during their continued trajectory after leaving the orifices. The turbulence induces a natural crimp and some variability in ultimate fiber diameter both between fibers and along the length of individual fibers. The crimp is irregular and will have a peak to peak amplitude that is usually greater than about one fiber diameter with a period usually greater than about five fiber diameters. At some point in their trajectory the fibers are contacted with a regenerating solution. Regenerating solutions are nonsolvents such as water, lower aliphatic alcohols, or mixtures of these. The NMMO used as the solvent can then be recovered from the regenerating bath for reuse. Preferably the regenerating solution is applied as a fine spray at some predetermined distance below the extrusion head.

A somewhat similar process is called "spunbonding" where the fiber is extruded into a tube and stretched by an air flow through the tube caused by a vacuum at the distal end. In general, spunbonded fibers are continuous while melt blown fibers are more usually in discrete shorter lengths.

Another process, termed "centrifugal spinning", differs in that the fiber is expelled from apertures in the sidewalls of a rapidly spinning drum. The fibers are drawn somewhat by air resistance as the drum rotates. However, there is not usually a strong air stream present as in meltblowing.

Dissolving Grade Pulp

Most currently available lyocell fibers are produced from high quality wood pulps that have been extensively processed to remove non-cellulose components, especially hemicellulose. These highly processed pulps are referred to as dissolving grade or high alpha (or high a) pulps, where the term alpha (or a) refers to the percentage of cellulose (Tappi, T 203 CM-99). Thus, a high alpha pulp contains a high percentage of cellulose, and a correspondingly low percentage of other components, especially hemicellulose. The processing required to generate a high alpha pulp and the fact that pulp yield is less because a high alpha pulp contains less of the starting raw material significantly adds to the cost of lyocell fibers and products manufactured from lyocell fibers.

Dissolving grade pulps are traditionally produced by the sulfite process but the kraft process can be used with certain modifications.

When the kraft process is used to produce a pulp, a mixture of sodium sulfide and sodium hydroxide is used to pulp the wood. Conventional kraft processes stabilize residual hemicelluloses against further alkaline attack, so it is not possible to obtain acceptable quality dissolving pulps, i.e., high alpha pulps, through subsequent treatment of kraft pulp in the bleaching stages because the hemicellulose remains in the pup. In order to prepare dissolving type pulps by the kraft process, it is necessary to give the raw material an acidic pretreatment before the alkaline pulping stage. A significant amount of material primarily hemicellulose, on the order of 10% or greater of the original wood substance, is solubilized in this acid phase pretreatment and thus process yields drop. Under the prehydrolysis conditions, the cellulose is largely resistant to attack, but the residual hemicelluloses are degraded to a much shorter chain length and can therefore be removed to a large extent in the subsequent kraft cook by a variety of hemicellulose hydrolysis reactions or by dissolution.

The prehydrolysis stage normally involves treatment of wood at elevated temperature (150-180° C.) with dilute mineral acid (sulfuric or aqueous sulfur dioxide) or with water alone requiring times up to 2 hours at the lower temperatures. In the latter case, liberated acetic acid from certain of the naturally occurring polysaccharides (predominantly the mannans in softwoods and the xylan in hardwoods) lowers the pH below 4.

A non-dissolving kraft pulp may also be used for lyocell. It has its degree of polymerization adjusted to 200 to 1100 and its copper number and transition metals adjusted to be compatible with the lyocell solvents. It will be described hereafter.

Degree of Polymerization

The term "degree of polymerization" (abbreviated as DP) refers to the number of D-glucose monomers in a cellulose molecule. Thus, the term "average degree of polymerization", or "average D.P.", refers to the average number of D-glucose molecules per cellulose polymer in a population of cellulose polymers.

The DP of a pulp will depend on the species of wood being used. Hardwoods and softwoods will have different DPs. The DP of a pulp will also depend on the pulping system and bleaching system being used. A kraft paper pulp which retains hemicellulose will have a higher DP than a kraft or some sulfite dissolving pulps which has far less and usually no hemicellulose. Some dissolving pulps can have a high DP.

The DP of a pulp will also depend of the method of measuring it. The measurements of DP in this application are by ASTM Test 1795-96 which uses a Cuene (cupriethylenediamine) solvent. Other tests use a Cuam (cuprammonium hydroxide) solvent or a LiCl/DMAc (lithium chloride/dimethylacetamide) solvent. Kiemme et al *Comprehensive Organic Chemistry, Vol.* 1, *Fundamentals and analytical methods*, Wiley-VCH 1998 report the following D.P. for pulps using Cuam: Papergrade softwood pulp: greater than 1000, dissolving grade softwood pulp: 300-1700, paper grade hardwood pulp: greater than 1000, dissolving grade hardwood pulp: 300-1000.

Sixta *Handbook of pulp*, Vol. 2, Wiley-VCH 2006 lists pine kraft pulp with ECF bleaching to have a $DP_v$ of 2207 measured with a Cuene solvent and $DP_w$ 2827 and a. $DP_n$ of 659 measured with LiCl/DMAc/cellulose solution using GPC procedure.

Sixta also shows the DP for different species, pulping systems and bleaching systems. Sixta provide the following DP: kraft pine with ECF (elemental chlorine free) bleaching has a Cuene DP of 2207 and a Cuam DP of 2827, kraft spruce with TCF (total chlorine free) bleaching has a Cuene 1648 and a Cuam DP of 2251, eucalyptus kraft with ECF bleaching has a Cuene DP of 2355 and a Cuam DP of 2847, beech sulfite pulp with ECF bleaching has a Cuene DP of 2240 and a Cuam DP of 2636, spruce sulfite pulp with TCF bleaching has a Cuene DP of 3074 and a Cuam DP of 3648, spruce sulfite pulp with ECF bleaching has a Cuene DP of 2486 and a Cuam DP of 3144, and beech sulfite pulping with TCF bleaching has a Cuene DP of 3489 and a Cuam DP of 4050. It is noted that the Cuam method has higher DPs than the Cuene method.

The DP distribution can be unimodal, i.e., the modal DP value being the DP value that occurs most frequently within the distribution, or multimodal, i.e., a distribution of cellulose DP values that has several relative maxima. A multimodal, treated pulp might be formed, for example, by mixing two or more unimodal, treated pulps, each having a different modal DP value. The distribution of cellulose DP values can be determined by GPC method (Sixta *Handbook of pulp*, Vol. 2, Wiley-VCH 2006).

Lowering the Degree of Polymerization

There are methods for reducing the DP of a non-prehydrolyzed kraft pulp to a DP in the range of 200 to 1000 or a DP in the range of 300 to 850, or a DP in the range of 400 to 750. It may be done without substantially reducing the hemicellulose content. The pulp can be a bleached, semi-bleached or unbleached kraft softwood pulp. Low DP saw dust pulp, lyocell pulp or viscose grade pulp can be manufactured using these methods.

This D.P. reduction treatment occurs after the pulping process and before, during or after the bleaching process, if a bleaching step is utilized. This includes a portion of the D.P. reduction step occurring at the same time as a portion of the bleaching step. Preferably the bleaching step, if utilized, occurs before treatment to reduce the average D.P. of the cellulose.

The methods of reducing the DP can include treating pulp with acid, or an acid substitute, or a combination of acids and acid substitutes, steam, alkaline chlorine dioxide, cellulase, the combination of at least one transition metal and a peracid, preferably peracetic acid, and the combination of ferrous sulfate and hydrogen peroxide.

The following methods are illustrative.

A means of treating the pulp in order to reduce the average D.P. of the cellulose without substantially reducing the hemicellulose content is to treat the pulp with acid. Any acid can be utilized, including, but not limited to: hydrochloric, phosphoric, sulfuric, acetic and nitric acids, provided only that the pH of the acidified solution can be controlled. Sulfuric acid is used because it is a strong acid that does not cause a significant corrosion problem when utilized in an industrial scale process. Additionally, acid substitutes can be utilized instead of, or in conjunction with, acids. An acid substitute is a compound which forms an acid when dissolved in the solution containing the pulp. Examples of acid substitutes include sulfur dioxide gas, nitrogen dioxide gas, carbon dioxide gas and chlorine gas.

The acid, or combination of acids, is preferably utilized in an amount of from about 0.1% w/w to about 10% w/w in its aqueous solution, and the pulp is contacted with the acid for a period of from about 2 minutes to about 5 hours at a temperature of from about 20° C. to about 180° C. The amount of acid or acid substitute will be sufficient to adjust the pH of the pulp to a value within the range of from about 0.0 to about 5.0. The amount, time, temperature and pH can be at a range within these ranges. The rate at which D.P. reduction occurs can be increased by increasing the temperature and/or pressure under which the acid treatment is conducted. Preferably the pulp is stirred during acid treatment, although stirring should not be vigorous.

When the reagent is steam, the steam is preferably utilized at a temperature of from about 120° C. to about 260° C., at a pressure of from about 150 psi to about 750 psi, and the pulp is exposed to the steam for a period of from about 0.5 minutes to about 10 minutes. The steam may include at least one acid. The steam may include an amount of acid sufficient to reduce the pH of the steam to a value within the range of from about 1.0 to about 4.5. The exposure of the pulp to both acid and steam permits the use of lower pressure and temperature to reduce the average D.P. of the cellulose compared to the use of steam alone.

When the reagent is a combination of at least one transition metal and peracetic acid, the transition metal(s) is present at a concentration of from about 5 ppm to about 50 ppm, the peracetic acid is present at a concentration of from about 5 mmol per liter to about 200 mmol per liter, and the pulp is contacted with the combination for a period of from about 0.2 hours to about 3 hours at a temperature of from about 40° C. to about 100° C.

When the reagent is a combination of ferrous sulfate and hydrogen peroxide, the ferrous sulfate is present at a concentration of from about 0.1 M to about 0.6 M, the hydrogen peroxide is present at a concentration of from about 0.1% v/v to about 1.5% v/v, and the pulp is contacted with the combination for a period of from about 10 minutes to about one hour at a pH of from about 3.0 to about 5.0.

Yet other means of treating the pulp in order to reduce the average D.P. of the cellulose, but without substantially reducing the hemicellulose content, is to treat the pulp with alkaline chlorine dioxide or with alkaline sodium hypochlorite, oxygen, or ozone.

The hemicellulose content of the treated pulp, expressed as a weight percentage, is from about 7% by weight to about 30% by weight or a range within that range. As used herein, the term "percent (or %) by weight" or "weight percentage", when applied to the hemicellulose or lignin content of treated pulp, means weight percentage relative to the dry weight of the treated pulp.

Hemicellulose and lignin content are measured by a sugar content assay based on Tappi T249 cm-00 and lignin content in the same sample was estimated from the solid residue after filtration of sugar solution from hydrolyzed samples.

Copper Number

If a nonprehydrolyzed kraft pulp is used for lyocell then its DP needs to be reduced as discussed above and it is further treated to lower the copper number to a value of less than 2.0, more preferably less than about 1.1, most preferably less than about 0.7, as measured by Tappi T430 cm-99. A low copper number is desirable because it is generally believed that a high copper number causes cellulose degradation during and after dissolution. The copper number is an empirical test used to measure the reducing value of cellulose. The copper number is expressed in terms of the number of milligrams of metallic copper which is reduced from cupric hydroxide to cuprous oxide in alkaline medium by a specified weight of cellulosic material. The copper number of the treated pulp can be reduced, for example, by treating the pulp with sodium borohydride or sodium hydroxide or by treating the pulp with one or more bleaching agents including, but not limited to, sodium hypochlorite, chlorine dioxide, peroxides (such as hydrogen peroxide) and peracids (such as peracetic acid).

The copper number of the low DP pulp used in the blend with lyocell fiber does not need a low copper number and need not be treated to reduce the copper number. It can, however, have a reduced copper number.

Fibrillated Blend of Lyocell and Low DP Pulp

Applicants have found that a fibrillated blend of lyocell and a pulp having a low degree of polymerization (DP) provides a material that does disperse, does filter well, and does provide better modulus of elasticity, toughness and strength. What physical attributes are provided and how much is provided will depend on the material with which the lyocell/pulp blend is combined.

In one embodiment the DP of the low DP pulp can be from 200 to 1000 as measured by ASTM Test 1795-96 which uses a Cuene (cupriethylenediamine) solvent. In another embodiment the DP of the low DP pulp can be from 300 to 850 as measured by ASTM Test 1795-96. In another embodiment the DP of the low DP pulp can be from 400 to 750 as measured by ASTM Test 1795-96.

In one embodiment the blend can be from 25 to 75 percent by weight lyocell with the remainder low DP pulp. In one embodiment the lyocell can be 40 to 60 percent by weight lyocell with the remainder low DP pulp. In one embodiment the lyocell can be 50 percent by weight with the remainder low DP pulp.

In one embodiment the lyocell has a length of 3 to 12 mm. In one embodiment the lyocell has a length of 3 to 10 mm. In one embodiment the lyocell has a length of 4 to 8 mm. In each of these embodiments fibril of the fibrillated lyocell usually has a diameter or width in the range of 30 to 800 nanometers to provide an aspect ratio of greater than 100 to one million or more.

The low DP material breaks into fibrils, particles and fines which are useful in dispersing the lyocell material.

The blend is formed by fibrillating the lyocell and low DP pulp together. In one embodiment the lyocell and low DP pulp may be mixed in a disintegrator or hydropulper for from 20 to 240 minutes. In another embodiment the lyocell and low DP pulp may be mixed in a disintegrator or hydropulper for from 60 to 180 minutes. The disintegrator operates at 2700 to 3300 rpm and the hydropulper at around 500 to 900 rpm. The consistency of the blend in the mixer will be from 0.5 to 5%. The consistency of the blend in the disintegrator is around 1-2% and in the hydropulper 2-4% on a weight basis. In one embodiment the energy required for fibrillation would be from 0.5 to 500 kwh per ton of blend. In one embodiment the energy required for fibrillation would be 0.5 to 100 kwh per ton of blend. In one embodiment the energy required would be 0.5 to 10 kwh per ton of blend. The energy in the disintegrator in one embodiment is from 160 to 190 kwh (kilowatt hours) per ton of blend and in another embodiment from 170 to 180 kwh per ton of blend and in one embodiment the energy of the hydropulper is less than 50 kwh per ton of blend and in another embodiment the energy in the hydropulper is from 0.5 to 25 kwh per ton of blend. The consistency of the blend can be changed to a consistency of 0.05 to 50% and added to the material to be reinforced or filtered. The fibrillated blend can be shipped in a water slurry at a consistency of 1 to 80%.

It has been noted that the 3 to 12 mm lyocell fibrillates while the shorter low DP fiber does not fibrillate significantly but does form fines. This is not true of higher DP pulp which does not form fines to the same extent as low DP pulp.

A low DP pulp/lyocell blend can have pulp fibers which have fibrillation. It has been noted that the lyocell fiber has more fibrillation in the blend than when fibrillated alone. Low DP fibers have limited fibrillation when fibrillated alone and less than when fibrillated in a blend with lyocell. High DP pulp in a pulp/lyocell blend has less fibrillation when compared to low DP pulp in a pulp/lyocell blend.

The blend could be incorporated into various materials such as rubber, polyvinyl alcohol, other elastomeric materials, cellulose ethers, polyurethane, polylactic acid and latexes such as polystyrene-co-butyl acrylate and in water soluble polymers. It could be incorporated into materials in which biodegradability as well as high maximum strength, modulus of elasticity and strength to rupture are required. The blend could be incorporated into adhesives to provide thermal creep. The blend could be used as a Theological modifier in water borne coatings. The blend could also be used in starch based materials.

Fibrillated lyocell by itself does not disperse easily. It tends to agglomerate. The tendency of the fibrils is to curve in on themselves or to intertwine.

Applicant has discovered that combining fibrillated lyocell with a low DP pulp having a DP of 200 to 1000, a material having good dispersibility is created. Fibrillated lyocell with higher DP pulp will not disperse as well as with the lower DP pulp. Fibrillated lyocell with higher DP pulp will not have as good a modulus of elasticity, toughness or strength as fibrillated lyocell with low DP pulp.

There are ways of showing dispersibility.

One is showing the turbidity stability of the blend in water using EPA method 180.1. In this test, the turbidity of slurry of the blend in Nephelometric turbidity units was measured 10 to 30 times in half to one minute to check the variability. An easily dispersible material will have a stable slurry. There will not be great variability. There will not be clumps and empty spots in the slurry. The standard deviation of the turbidity will be small.

Lyocell alone can have a standard deviation of 0.4 to 2.5. A blend of fibrillated lyocell and low DP pulp which have been fibrillated together can have a standard deviation of 0.1 to 0.3. A blend of fibrillated lyocell and higher DP pulp which have been fibrillated together can have a standard deviation of 0.5 to above 9.

Another method is to determine the time it takes to filter a specified amount of water from a water/cement mix. The longer it takes to filter the specified amount of water the better the dispersion of the fiber. It takes about one and a half to two times as long for fibrillated lyocell alone or a blend of fibrillated lyocell and higher DP pulp which have been fibrillated together to drain than a fibrillated low DP pulp.

For example, if it takes around one minute for the fibrillated low DP pulp to drain a specified amount of water from the cement mixture then it will take the fibrillated lyocell or the blend of fibrillated lyocell and higher DP pulp to from a minute and half to two minutes to drain the same amount of water.

It will take even longer for the blend of fibrillated lyocell and low DP pulp which have been fibrillated together to drain. It will take the blend of fibrillated lyocell and low DP pulp from two and a half to three and a half times longer to drain than the low DP pulp by itself. For example, if it takes the low DP pulp by itself a minute to drain a specified amount of water then it will take the blend from two and a half to three and a half minutes to drain the same amount of water.

The faster drainage times shows that there is less material throughout the water cement mix filtering the system. There are open spots through which the water can drain quickly. The drainage is slowed down when there is a uniform distribution of material throughout the cement matrix.

Applicant is unsure why the low DP pulp provides better dispersion. The properties of the fibers were checked with FQA (Jeremy Meyers and Hiroki Nanko TAPPI Spring 2005 Technical Conference, pages 1-8) to see if there was an attribute that might cause the dispersion. Table 5 has a comparison of fiber properties.

The viscosity as measured by Tappi T-230 of a low DP pulp is from 20 to 50 centipoises while the viscosity of the higher DP pulps is 70 centipoises and up. The Carboxyl groups of a low DP pulp are 4.25 to 5.25 as compared to 3 to 3.5 for a higher DP pulp. The number of fibers per gram of pulp is greater than 5.5 million for a low DP pulp as compared to 4.5 to 5.3 million for a higher DP pulp. The LWAFL (length weighted average fiber length) is under 2.3 mm for a low DP pulp as compared to greater than 2.4 mm for a higher DP pulp. The kink index for a low DP pulp is greater than 2 for a low DP pulp as compared to 1.8 or less for a high DP pulp. The curl index for a low DP pulp is greater than 0.2 for a low DP pulp as compared to 0.18 or lower for a higher DP pulp. The WWAFL (weight weighted average fiber length) of a low DP pulp is less than 3.2 mm as compared to 3.3 or higher for a higher DP pulp. The LW fines [length weighted, under 0.2 mm] of a low DP pulp is greater than 6% by weight as compared to less than 5.3% for a higher DP pulp. Upon disintegration (Tappi T227 om-94), a low DP pulp has much lower fiber length, higher population and much higher fines than a higher DP pulp refined under same condition (Tables 2 and 6).

It may be that the additional fines aid in the dispersion and entanglement reduction of the lyocell/low DP pulp blend. It may be that one of the other differences account for the dispersion and reduction in entanglement.

Additives

For many uses a hydrophobic fiber is needed. The fibrillated blend may be treated with additives to allow better blending with the materials such as rubber, thermoplastics, and other materials with which it can be combined. Additives that can be used for hydrophobicity are sizing agent such as AKD or ASA or a cationic surfactant, a low level of substitution of cellulose acetate, dispersant (like Hydropalat 1080), attaching a silane to cellulose, reacting a monoamine with a hydrophobic end to the carboxyl groups on cellulose Lignin Each of the fibrillated blends of lyocell and low DP pulp can also be made hydrophobic by the use of lignin in the lyocell, the low DP pulp or both. The starting material for the lyocell would be a lightly bleached or unbleached pulp. The low DP pulp can be unbleached or lightly bleached. The amount of lignin can be as high as 90% of the weight of the lyocell or pulp or both by the addition of lignin. Fiber (wood fiber or lyocell) with lignin is more hydrophobic and can enhance bonding with hydrophobic polymers like rubber.

EXAMPLES

In the following examples Weyerhaeuser Peach® pulp is used as an example of a low DP pulp. Examples of high DP pulps are Weyerhaeuser fluff pulps NB 416, FR 416, FR 516 and LV bleached. UB unbleached pulp is an example of a low DP pulp containing lignin. LV is a highly carboxylated pulp (30 meq/loogram) using Weyerhaeuser Longview pulp as starting pulp and the method described in U.S. Pat. No. 6,524,348.

The following two examples show the manufacture of a lyocell/low DP pulp blend using a low energy hydropulper and a high energy disintegrator.

Example 1: Use of Hydropulper (90 Minutes)

A 2.75 wt % consistency solution with water (56.5 kg), 6 mm lyocell fibers (0.91 kg at 92% solids), and never-dried Peach® pulp (3.65 kg at 23% solids) was added to a 40 gallon lab hydropulper. The hydropulper was turned on and ran for 90 minutes. A "typical" hydropulper would run at about 700 rpm. The energy in the hydropulper is 25 kwh per ton of blend. Dried Peach® can be used too.

Example 2: Use of Disintegrator (90 and 180 Minutes)

A 1.2 wt % consistency solution with water (1.94 kg), 6 mm long lyocell fibers (13.2 g at 92% solids), and never-dried Peach® pulp (52.2 g at 23% solids) was added to a standard British Disintegrator (Tappi T227 om-94). The Disintegrator was turned on and ran at 3000 rpm for 90 and 180 minutes. The energy in the disintegrator is 175 kwh per ton of blend. The pulps may be dry or never dry. Dry wood pulps include fluff NB 416, FR 416, Peach® pulp and unbleached pulp (UB). Table 1 shows that highly fibrillated cellulose blend from 6 mm long lyocell and Peach® pulp had lower freeness than lyocell/NB 416 or lyocell/FR 416 blends with the same lyocell/pulp blend ratio made under the same refining condition. A highly fibrillated cellulose blend from 6 mm long lyocell and unbleached pulp with DP of 760 and lignin content of 1.9% also had low freeness. It is believed that low freeness indicates more fines. Fines are particles having a size less than 250 microns.

TABLE 1

Freeness of cellulose pulp and lyocell fiber blend with high fibrillation

| Composition Lyocell/pulp | Freeness (CSF, ml) of the slurry | | | |
|---|---|---|---|---|
| | Lyocell/UB* | Lyocell/ Peach | Lyocell/ NB416 | Lyocell/FR416 |
| | British Disintegrator (consistency: 1.2%, 90 minutes, example 2) | | | |
| 0/100 | | 696 | >700 | 704 |
| 5/95 | | 630 | | |
| 25/75 | | 190 | 290 | 330 |
| 50/50 | 108 (6.68)** | 68 (6.30)** | 106 (7.32)** | 94 |
| 75/25 | | 44 | 58 | 58 |
| 95/5 | | 49 | 55 | 54 |
| 100/0 | | 36 (1.90)** | | |

TABLE 1-continued

| Freeness of cellulose pulp and lyocell fiber blend with high fibrillation | | | | |
|---|---|---|---|---|
| | Freeness (CSF, ml) of the slurry | | | |
| Composition Lyocell/pulp | Lyocell/UB* | Lyocell/ Peach | Lyocell/ NB416 | Lyocell/FR416 |
| | British Disintegrator (consistency: 1.2%, 180 minutes, example 2) | | | |
| 50/50 | | 0 | 22 | 0 (100% lyocell) |
| | Hydropulper (consistency: 3%, 90 minutes, example 1) | | | |
| 50/50 | | 38 | 75 | |

*UB = unbleached kraft pulp,
**Hemicellulose (xylan and mannan).

Example 3: Properties of Refined Lyocell/pulp Blend

This example shows that a refined Peach®/lyocell blend or a refined unbleached low DP pulp/lyocell blend will generate more fines during refining than a refined high DP pulp/lyocell blend as shown in Table 2. The high DP pulps are LV bleached and NB 416. The extra fines from pulp, higher population and shorter low DP fibers in their blend with lyocell will enhance lyocell fibril dispersion in the blend and reduce mechanical entanglement among lyocell fibrils due to extra dilution and spacing among long lyocell fibrils. The blend may contain from 25 to 75 weight % lyocell and 75 to 25 weight percent low DP pulp. At high lyocell content (95/5 lyocell/NB416), the blend may have higher fines, but lower population than lyocell/Peach of same composition (table 2), but this extra fines from lyocell/NB416 is possibly from over-fibrillated lyocell fiber. This will not benefit the utilization of lyocell fibrils for composite applications. Lyocell/Peach with 95/5 ratio also had high fine than 75/25 ratio. Again, fines from lyocell do not imply higher dispersion. High lyocell ratio in blend will have high entanglement even it is high fines. This indicated that a proper lyocell/pulp ratio is important and only fines from pulp will benefit dispersion for these blends with proper lyocell/pulp ratio.

In this example, lyocell alone or lyocell was combined with the different pulps in the ratios shown and the blends were fibrillated either in a British disintegrator or a hydropulper for the times shown. The blends were in aqueous solution at the consistencies disclosed in Example 1 for the hydropulper and example 2 for the British disintegrator. The resulting material was tested for the fiber properties shown.

TABLE 2

| Properties of refined lyocell fiber or its 50/50 blend with pulp | | | | | |
|---|---|---|---|---|---|
| Lyocell (8 mm) | Yes | Yes | Yes | Yes | Yes |
| Pulp used | No | LV | NB416 | UB | Peach |
| Pulp bleached | | yes | yes | no | yes |
| DP (fibrillated blend) | 589 | 1100* | 1140 | 690 | 542 |
| Fiber Properties FQA | British disintegrator (90 minutes, example 2) | | | | |
| Fibers per gram, million | 22.1 | 8.6 | 11.0 | 14.4 | 15.6 |
| LWAFL, mm | 2.26 | 2.18 | 2.48 | 2.13 | 2.12 |
| Fiber Coarseness, mg/100 m | 11.3 | 20.8 | 16.2 | 14.4 | 15.7 |
| Kink Index | 2.29 | 1.4 | 2.4 | 2.5 | 3.1 |
| Curl Index | 0.35 | 0.19 | 0.38 | 0.39 | 0.42 |
| WWAFL, mm | 3.75 | 3.31 | 3.81 | 3.64 | 3.60 |
| LW Fines, % | 14.0 | 7.1 | 9.2 | 11.0 | 11.9 |
| Fiber Properties FQA | Hydropulper (90 minute, example 1) | | | | |
| Fibers per gram, million | | | | | |
| LWAFL, mm | | | 2.22 | | 1.45 |
| Fiber Coarseness, mg/100 m | | | | | |
| Kink Index | | | 2.22 | | 2.26 |
| Curl Index | | | 0.24 | | 0.28 |
| WWAFL, mm | | | 3.43 | | 2.96 |
| LW Fines, % | | | 9.2 | | 22.6 |
| Properties of refined lyocell fiber blend with pulp | | | | | |
| Lyocell (L)/Pulp ratio | L/NB416 95/5 | L/Peach ® 95/5 | L/Peach ® 75/25 | L/Peach ® 50/50 | L/Peach ® 25/75 |
| Fiber Properties FQA | 90 minutes refining (example 2) | | | | |
| Fibers per gram, million | 13.4 | 17.3 | 19.9 | 15.6 | 16.7 |
| LWAFL, mm | 2.55 | 2.68 | 2.23 | 2.12 | 2.02 |
| Fiber Coarseness, mg/100 m | 12.7 | 12.8 | 11.8 | 15.7 | 15.5 |
| Kink Index | 3.3 | 3.3 | 3.3 | 3.1 | 2.8 |
| Curl Index | 0.56 | 0.59 | 0.54 | 0.42 | 0.33 |
| WWAFL, mm | 4.19 | 4.19 | 3.74 | 3.60 | 3.19 |
| LW Fines, % | 13.8 | 12.9 | 11.7 | 11.9 | 11.0 |

LV is a paper grade pulp from Longview pulp mill Weyerhaeuser with 30 meq/100 gram of carboxyl groups.
*estimated DP is 1100.

Example 4: Suspension Stability of Refined Lyocell/pulp Blend

One method of showing dispersion is showing the turbidity stability of the blend in water using EPA method 180.1. The following table gives a comparison among fibrillated lyocell, a blend of fibrillated lyocell and Peach® pulp having a DP of 700, and a blend of fibrillated lyocell and NB 416 pulp having a DP of 1500.

TABLE 3

| Turbidity (11 reading in half minute) of the suspension in water (0.003%) | | | |
|---|---|---|---|
| | Sample | | |
| | Lyocell | Lyocell/Peach ® | Lyocell/NB 416 |
| Blend | | 50/50 | 50/50 |
| Standard deviation (STDEV) | 2.25 | 0.29 | 8.56 |

In this test for slurry stability, half minute time is used to record turbidity of the slurry. Stable slurry will have low turbidity variability (lower standard deviation). The stability of the lyocell/low DP blend has far greater stability than the lyocell alone or the lyocell and higher DP pulp.

The following table provides more suspension stability data for other samples. As can be seen, suspension from Lyocell/Peach® blend at 50/50 ratio still has the highest suspension stability (the lowest standard deviation).

It is known that charged nanocellulose surface improves nanocellulose dispersion but a blend of lyocell with high carboxyl group pulp with high DP (the LV fiber) did not show good stability (a high standard deviation). This may be the result of a poor generation of fines

TABLE 4

| Turbidity (25 reading in one minute) of the suspension in water (0.003%) | | | | |
|---|---|---|---|---|
| | Lyocell/Pulp | | | |
| | 50/50 | 50/50 | 50/50 | 50/50 |
| Pulp | Peach ® | FR416 | LV | Peach ® |
| additive | no | no | no | no |
| STDEV | 0.26 | 0.58 | 0.84 | 0.13 |

Another method is to determine the time it takes to filter a specified amount of water from a water/cement mix. The longer it takes to filter the specified amount of water the better the dispersion of the fiber. The three materials used in the first test as well as a low DP pulp sample were used. The filtration times in seconds were: low DP pulp alone, 55 seconds; lyocell alone 101 seconds; lyocell/high DP (1500 DP) 50/50 blend 103 seconds; and lyocell/low DP (700 DP) 50/50 blend 178 seconds. Again the low DP blend showed better dispersion.

Applicant is unsure why the low DP pulp provides better dispersion. The properties of the fibers were checked with FQA (Jeremy Meyers and Hiroki Nanko TAPPI Spring 2005 Technical Conference, pages 1-8) to see if there was an attribute that might cause the dispersion. Table 5 has a comparison of fiber properties.

TABLE 5

| Fiber properties | | | | |
|---|---|---|---|---|
| | Peach ® | FR 416 Fluff | FR 516 Fluff | NB 416 fluff |
| Chemical Properties | | | | |
| Viscosity, mPa * s | 22 | 78 | 70 | 224 |
| DP | 700 | 1148 | 1110 | 1498 |
| R-10, % | 81.5 | 86.9 | 86.6 | 87.5 |
| R-18, % | 85.7 | 87.4 | 87.2 | 87.8 |
| Carboxyl group, meq/100 g | 4.65 | | | 3.3 |
| Fiber Properties FQA | | | | |
| Fibers per gram, million | 5.7 | 4.9 | 5.2 | 4.6 |
| LWAFL, mm | 2.24 | 2.55 | 2.44 | 2.67 |
| Fiber Coarseness, mg/100 m | 20.8 | 21.2 | 20.3 | 21 |
| Kink Index | 2.2 | 1.8 | 1.7 | 1.4 |
| Curl Index | 0.22 | 0.18 | 0.18 | 0.14 |
| WWAFL, mm | 3.13 | 3.44 | 3.31 | 3.4 |
| LW Fines, % | 6.2 | 5.2 | 5.3 | 4.4 |

It can be seen that the viscosity (Tappi T-230) and DP of Peach® pulp are lower than the others. The R-10 and R-18 (Tappi T-235 cm-00) of Peach® pulp are slightly lower than the others. The Carboxyl groups of Peach® pulp are higher than NB 416. The number of fibers per gram of Peach® pulp is higher than the others. The LWAFL (length weighted average fiber length) of Peach® pulp is lower than the others. The kink and curl index of Peach® pulp are higher than the others. The WWAFL (weight weighted average fiber length) of Peach® pulp is lower than the others and the LW fines [length weighted, under 0.2 mm] of Peach® pulp is higher than the others. Upon disintegration (Tappi T227 om-94), Peach® pulp has much lower fiber length, higher population and much higher fines than the FR 416 refined under same condition (Table 6).

TABLE 6

| Refining performance of Peach and fluff pulp | | | | | | | | |
|---|---|---|---|---|---|---|---|---|
| | FR 416 | | FR 416 | | Peach ® | | Peach ® | |
| Chemical Properties | | | | | | | | |
| Refining time (minute) | 5 | 90 | 5 | 90 | 5 | 90 | 5 | 90 |
| Freeness | 751 | 704 | | | 749 | 696 | | |
| Fiber Properties FQA | | | | | | | | |
| Fibers per gram, million | | | 6.8 | 7.0 | | | 9.7 | 12.8 |
| LWAFL, mm | 2.54 | 2.59 | 2.44 | 2.47 | 2.16 | 2.20 | 2.05 | 2.05 |
| Fiber Coarseness, mg/100 m | | | 20.1 | 19.7 | | | 18.0 | 17.2 |
| Kink Index, 1/mm | 1.8 | 1.6 | 2.2 | 1.9 | 2.3 | 2.1 | 3.0 | 2.7 |
| Kink number, 1/mm | 0.9 | 0.8 | 1.0 | 0.9 | 1.1 | 1.0 | 1.3 | 1.1 |
| Curl Index | 0.16 | 0.12 | 0.19 | 0.16 | 0.19 | 0.16 | 0.25 | 0.21 |

TABLE 6-continued

| Refining performance of Peach and fluff pulp | | | | | | | | |
|---|---|---|---|---|---|---|---|---|
| | FR 416 | | FR 416 | | Peach ® | | Peach ® | |
| WWAFL, mm | 3.30 | 3.53 | 3.20 | 3.24 | 3.02 | 3.10 | 2.75 | 2.79 |
| LW Fines, % | 5.8 | 5.7 | 5.8 | 5.6 | 7.9 | 8.6 | 6.4 | 8.1 |

The invention claimed is:

1. A fibrillated blend of lyocell and cellulosic pulp having a degree of polymerization of 200 to 1000 as measured by ASTM Test 1795-96, the lyocell and cellulosic pulp having been fibrillated together to form a fibrillated blend, wherein at least a portion of the lyocell fiber has a length of 3 to 12 mm, and wherein the lyocell is from 25 to 75 weight percent of the blend.

2. The blend of claim 1 wherein at least one of the lyocell or the cellulosic pulp contains lignin.

3. The blend of claim 1 wherein the blend is hydrophobic.

4. The blend of claim 1 wherein the blend has been treated with an additive.

5. The blend of claim 4 wherein the additive is selected from surfactants, dispersants, nanoclay, carbon black, silica and lignin or lignin derivatives.

6. A material comprising a fibrillated blend of lyocell and cellulosic pulp having a degree of polymerization of 200 to 1000 as measured by ASTM Test 1795-96, the lyocell and cellulosic pulp having been fibrillated together to form a fibrillated blend, wherein at least a portion of the lyocell has a length of 3 to 12 mm, and wherein the lyocell is from 25 to 75 weight percent of the blend.

7. The material of claim 6 wherein at least one of the lyocell or the cellulosic pulp contains lignin.

8. The material of claim 6 wherein the blend is hydrophobic.

9. The material of claim 6 wherein the blend has been treated with an additive.

10. The material of claim 9 wherein the additive is selected from surfactants, dispersants, nanoclay, carbon black, silica and lignin derivatives.

11. The material of claim 6 further comprising polyvinyl alcohol, cellulose ether, polyurethane, polylactic acid, polystyrene-co-butyl acrylate, water soluble polymers, nonwovens, adhesives, water borne coatings or starch based materials.

12. The material of claim 6 further comprising thermoplastic or thermoset or gel materials.

13. The material of claim 6 further comprising elastomeric materials or rubber.

14. The fibrillated blend of lyocell and cellulosic pulp of claim 1, wherein the cellulose pulp has a degree of polymerization of 300 to 800 as measured by ASTM Test 1795-96.

15. The fibrillated blend of lyocell and cellulosic pulp of claim 14, wherein the cellulose pulp has a degree of polymerization of 400 to 750 as measured by ASTM Test 1795-96.

* * * * *